US006246386B1

(12) United States Patent
Perner

(10) Patent No.: US 6,246,386 B1
(45) **Date of Patent: *Jun. 12, 2001**

(54) INTEGRATED MICRO-DISPLAY SYSTEM

(75) Inventor: Frederick A. Perner, Palo Alto, CA (US)

(73) Assignee: Agilent Technologies, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/099,918

(22) Filed: Jun. 18, 1998

(51) Int. Cl.[7] ..... G09G 3/36
(52) U.S. Cl. ..... 345/90
(58) Field of Search ..... 345/90

(56) References Cited

U.S. PATENT DOCUMENTS 4,432,610 * 2/1984 Kobayashi et al. ..... 350/331 R
5,225,823 7/1993 Kanaly ..... 340/793
5,337,408 * 8/1994 Fung et al. ..... 395/162
5,349,366 * 9/1994 Yamazaki et al. ..... 345/92
5,422,996 * 6/1995 Patil et al. ..... 395/164
5,471,225 * 11/1995 Parks ..... 345/98
5,502,576 * 3/1996 Ramsay et al. ..... 358/444
5,555,460 * 9/1996 Ericsson ..... 345/203
5,613,103 * 3/1997 Nobutani et al. ..... 395/501
5,627,557 * 5/1997 Yamaguchi et al. ..... 345/90
5,670,973 * 9/1997 Bassetti et al. ..... 345/58
5,821,910 * 10/1998 Shay ..... 345/99
5,907,329 * 5/1999 Nobutani et al. ..... 345/97

* cited by examiner

*Primary Examiner*—Jeffery Brier
*Assistant Examiner*—Anthony J. Blackman

(57) ABSTRACT

An integrated display device and method of driving liquid crystal within a display area of the device include providing dual port memory cells that isolate write operations to the pixels from read operations within the pixels. Preferably, each pixel has an array of integrated dual port memory cells, with the number of cells in the array being equal to the number of bits per pixel within each frame of pixel data. The dual port memory cell may be an electrical series connection of a bit-storage device having write access circuitry (e.g., a write access transistor) on one side and read access circuitry (e.g., two read access transistors) on the opposite side. Such a series connection of devices enables the rate of driving the liquid crystal to be set independently from the rate of receiving pixel data at the pixels. The integrated display device also includes an on-chip frame buffer circuitry, as well as other circuitry for read and write operations.

16 Claims, 12 Drawing Sheets

INTEGRATED MICRO-DISPLAY SYSTEM

TECHNICAL FIELD

The invention relates generally to liquid crystal display systems and more particularly to a liquid crystal display system capable of storing a complete frame of video data.

DESCRIPTION OF THE RELATED ART

Liquid crystal displays (LCDs) have become a popular form of electronic displays. LCDs are composed of liquid crystals which are positioned between two pieces of glass. The crystals can be aligned such that in a normal state, light easily propagates through the liquid crystals. However, when an electrical field is present, the liquid crystals alter their alignment, greatly reducing the amount of light passing through the crystals. By applying an electrical field at selected "pixels" or discrete regions on the LCD, an image can be formed. An LCD can have more than 1,228,800 pixels. The resolution of the LCD is directly related to the density of pixels in the LCD array.

There are a number of alternative types of liquid crystals utilized commercially in LCDs. A first major type is referred to as twisted nematic liquid crystals. LCDs with twisted nematic liquid crystals produce pictures with high contrast. However, LCDs with twisted nematic liquid crystals have relatively narrow viewing angles, as well as slow molecular rotation times. A second type of liquid crystals is referred to as ferroelectric liquid crystals. LCDs with ferroelectric liquid crystals have wider viewing angles as a result of their small cell gaps, typically 1 to 2 microns. In addition, ferroelectric liquid crystal displays (FLCDs) have a faster molecular rotation speed, typically in the range of 50 to 100 micro seconds.

A typical FLCD includes a display chip covered with a structure containing the ferroelectric liquid crystals, an illuminator and viewing optics. The operation of the FLCD is supported by a host computer and an external frame buffer memory. In order to display a color image on the FLCD, a frame of image data is transferred from the host computer to the external frame buffer memory. The external frame buffer memory supplies multi-bit pixel data to each pixel in the FLCD. The color image represented by the frame of pixel data is displayed on the FLCD as a result of a time sequential process of loading each pixel of the FLCD with its multi-bit pixel data from the external frame buffer memory. Typically, each pixel in the FLCD has a single bit storage element. Therefore, the external frame buffer memory must supply a series of single bits of pixel data to the pixels in order to display a particular color with a particular grayscale at each pixel. The number of bits required for each pixel of the FLCD to produce a desired color at a desired intensity may be 24 or more bits (e.g., three colors with eight bits of grayscale per color).

Depending upon the bits of the pixel data, light from the illuminator is either reflected to or deflected from the viewing optics. The pixels in the FLCD act as time-modulated micro mirrors in concert with the illuminator to produce the color image, which is determined by the values of the bits of pixel data. Quality of the color image is determined by the density of the pixels, the number of color-related bits delivered to each pixel, and the rate that each frame of color is refreshed. The quality of color image is practically limited by the rate of the transfer of pixel data from the frame buffer memory to the pixels.

To display a high quality color image on the FLCD having the single bit storage elements, a high bandwidth data link from the external frame buffer memory to the individual pixels is required. However, high bandwidth data links are expensive, potentially noisy, and require a great amount of power.

U.S. Pat. No. 4,432,610 to Kobayashi et al. (hereinafter Kobayashi) entitled "Liquid Crystal Display Device," describes LCDs with various storage elements in the pixels. All of the storage elements described in Kobayashi are single-bit storage elements.

A concern with single-bit storage elements in an LCD relates to the need to continually supply bits of pixel data at a high data transfer rate to develop a high resolution image on the LCD. Unless a sufficiently high data transfer rate is achieved, there will be limitations on the size of the LCD array, the display frame rate, and/or the number of bits of pixel data that may be transferred per frame. These physical limits affect the quality of the display image.

Another LCD with single-bit storage elements is described in U.S. Pat. No. 5,471,225 to Parks entitled "Liquid Crystal Display with Integrated Frame Buffer." The single-bit storage elements in the LCD of Parks are static random access memory (SRAM) cells comprised of three transistors and two resistors. The SRAM cells allow the LCD to display an image for an indefinite amount of time without refreshing. However, the data transfer rate concern identified above for the LCDs of Kobayashi exists for the LCD of Parks.

U.S. Pat. No. 5,627,557 to Yamaguchi et al. (hereinafter Yamaguchi) entitled "Display Devices," describes an improved pixel for an LCD. The pixel includes circuitry for providing an inverse of the pixel data for DC balancing by using two dynamic sample-and-hold capacitors in addition to a single storage element. The DC balancing circuitry reduces the required data transfer rate from an external frame buffer memory to the pixels in the LCD by a factor of 2.

In another embodiment, Yamaguchi describes a pixel with the ability to display a first bit of pixel data while writing a second bit of pixel data. Each pixel in this embodiment functions as a pixel with a two-bit storage element, further reducing the necessary data transfer rate. However, the LCDs of Yamaguchi still require a relatively high data transfer rate, and potentially impose limitations relating to LCD size, frame rate, and color-related bits per pixel, as described above.

The high bandwidth requirement exists even when the device driving the LCD is in a "static" display mode. For example, a laptop computer for which an LCD displays a static (i.e., continuous) image of a portion of a word processing document requires a high data transfer rate to repeatedly supply identical pixel data to the LCD. A data transfer rate in the range of 100 Mega bits-per-second (bps) to more than 2 Giga bps may be required to maintain the image of the document.

What is needed is an LCD system having pixels with storage elements that relax the data rate and bandwidth requirements typically imposed by operation of an LCD device.

SUMMARY OF THE INVENTION

An integrated display device and a method of driving liquid crystal within a display area of the device include integrating memory cells within each pixel of the display device. Preferably, the memory cells allow read operations of pixel data to be isolated from write operations. This is achieved by providing dual port memory cells. Also in the preferred embodiment, the number of dual port memory cells within each pixel is equal to the number of bits of pixel data directed to the pixel per frame. That is, if a frame of pixel data includes eighteen bits of color and grayscale information, each pixel preferably includes an array of eighteen dual ported memory cells.

Each dual ported memory cell may be a dynamic random access memory (DRAM) cell formed by a write port, a storage element, and a series gated read port. The dual ported memory cell can be formed by a series connection of four devices, such as four transistors. Alternatively, the dual ported memory cell can be formed by a series connection of three devices and a capacitor, such as three transistors and a planar, a stacked, or a trench capacitor. In the four-transistor embodiment, one transistor functions as a capacitor to store a charge that is indicative of the value of a bit of the pixel data.

On one side of the storage device is a write access device that is manipulated during a write operation to connect the storage device to a write bit line from which the pixel data is received. Connected to the same storage device are two series connected read devices that are separately controlled to read data to a local read bit line. The series connected read devices function as a local read decoder. The bit of pixel data within the storage device is read only when both of the read devices are "on." One read device may be controlled by a read_color signal, while the other read device may be controlled by a read_grayscale signal. Because the reading operation of a particular memory cell is executed only when the correct combination of signals is present at that memory, a time sequential reading of the entire cell array can occur. Moreover, the time sequential reading of a particular memory array can be identically and simultaneously implemented at all of the memory arrays within the display area of the device.

The display device is typically a liquid crystal device, and preferably a ferroelectric liquid crystal device (FLCD). However, the array of dual port memory cells may be utilized in other display devices in which optical properties of individual pixels are determined by receiving multi-bit pixel data. In addition to the array of memory cells, each pixel preferably includes a sense amplifier, a DC balance circuit and a driver circuit.

A matrix of pixels defines the display area of the integrated display device. Although not critical to the invention, the matrix of pixels may contain enough pixels for a VGA size. Fabricated on the integrated display device are preferably supporting circuitry for the read and write operations, including frame buffer circuitry. The frame buffer circuitry may include two data registers for temporarily storing and transferring a frame of digital image data to the pixels, a segment at a time. The two data registers can operate in an alternating fashion such that when one data register is storing a segment of data, the other data register is transferring another segment of data that was previously stored within that data register. When the storing and transferring operations have been completed, the two data registers can switch their operations such that the data register that was storing is now transferring the stored segment of data. In this manner, a frame of digital image data can be conducted into the pixels in a continuous flow.

Other components of the supporting circuitry include a write clock generator, a write row driver, a write control circuitry, and a write bit line driver. These components are primarily associated with the write operation of the integrated display device. Components that are primarily associated with the read operations include a read clock generator, a read DRAM clock generator, a read row driver, and a read column driver.

In the preferred embodiment, the read sequence is selected to minimize a potential data degradation from a capacitance charge that may be trapped between the two read access devices of a memory cell. The read sequence is organized such that, within each pixel, the first read access devices of the memory cells are addressed only once during one read cycle. Also in the preferred embodiment, the write operation is prohibited during a portion of read operation such that a memory cell is not simultaneously addressed during the read and write operation that may result in erroneously reading of data.

A method of driving liquid crystal in a matrix of pixels of an integrated display device includes a step in which a frame of multi-bit pixel data is conducted to the memory cells within each of the pixels in the matrix. Next, the frame of multi-bit pixel data is written into the pixels in the matrix. After the frame of multi-bit pixel data has been written, the memory cells within the matrix of pixels are selectively accessed to display the frame of multi-bit pixel data by sequentially reading the data stored in each memory cell. Preferably, the sequential reading involves addressing a first read transistor of series-gated transistors within each memory cell only once during a read cycle, thereby minimizing potential data degradation in the memory cells. Lastly, electrical fields are applied to liquid crystal in the pixels of the matrix. The electrical fields correspond to the pixel data that were stored in the memory cells.

One advantage of the invention is that the rate of writing pixel data to the pixels may be selected to be compatible with a host system, while the rate of reading pixel data may be selected to maximize image quality.

Another advantage of the invention is that all of the bits required for a particular image can be stored into the pixels. The capacity to store the entire frame within the pixels eliminates the need for an external frame buffer and relaxes the data rate and bandwidth requirements for providing pixel data to the display device.

DETAILED DESCRIPTION

Figure 1:
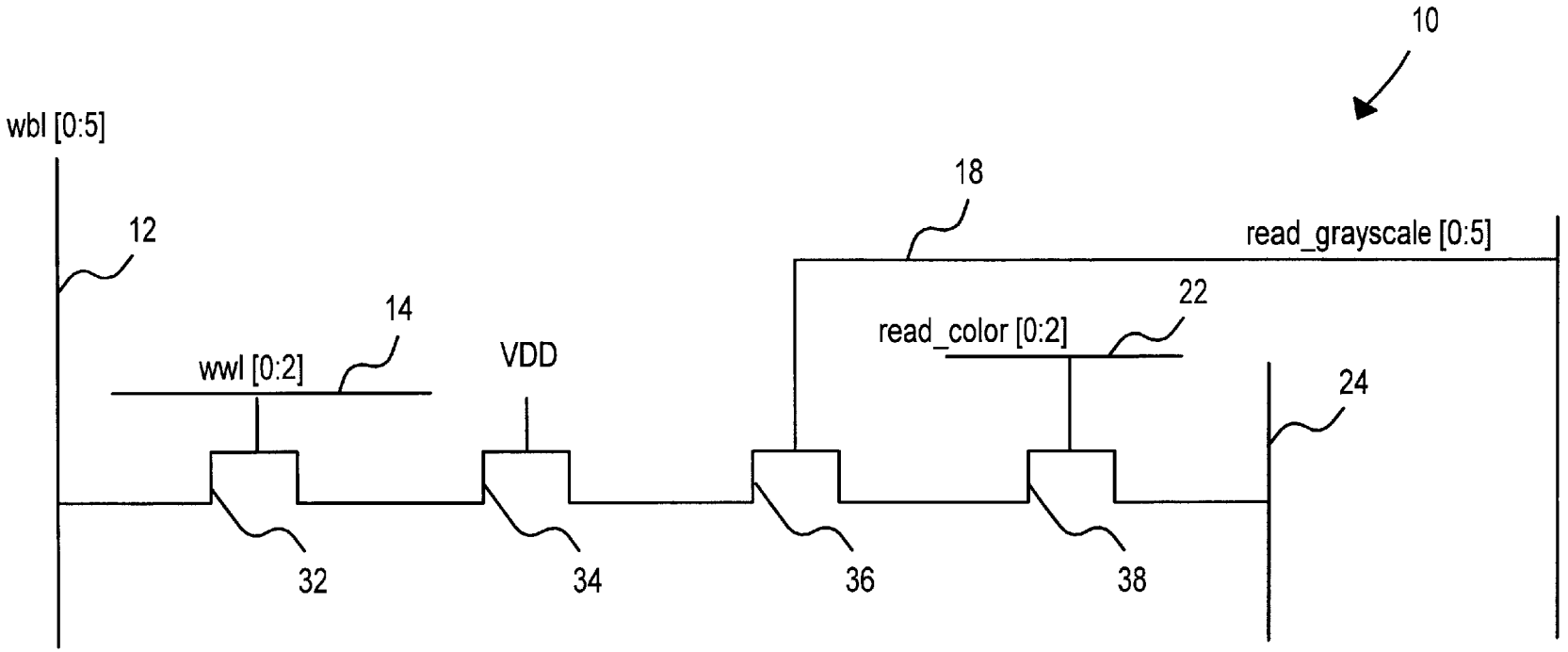
FIG. 1 is a schematic diagram of a dual port dynamic random access memory cell in accordance with the invention.

With reference to FIG. 1, a dual port dynamic random access memory (DRAM) cell 10 for use in LCD applications is shown connected to a write bit line 12 and a read bit line 24. A write transistor 32, a storage transistor 34, a vertical read transistor 36, and a horizontal read transistor 38 have main conduction paths that are connected in series, providing a conduction path from the write bit line 12 to the read bit line 24. The transistors 32, 34, 36 and 38 are shown as metal-oxide semiconductor (MOS) transistors.

A gate of the write transistor 32 is connected to a write word line 14, while a gate of the storage transistor 34 is connected to a supply voltage (VDD). Gates of the vertical read transistor 36 and the horizontal read transistor 38 are connected to a vertical read line 18 and a horizontal read line 22, respectively.

In order to write a bit of pixel data into the dual port DRAM cell 10, the storage transistor 34 is initially charged up to a set voltage by applying VDD, for example 5 volts, to the gate of the storage transistor 34. The storage transistor 34 essentially functions as a capacitor. The actual writing of the data is accomplished by addressing the write word line (wwl) 14, turning on the write transistor 32, and receiving the bit of pixel data from the write bit line (wbl) 12 while the conduction path to the read bit line (rbl) 24 is blocked by either the transistor 36 or the transistor 38, either of which is turned "off" by a control signal to the vertical read line 18 or the horizontal read line 22, respectively. Depending on whether the bit is a "0" or "1," the voltage stored in the storage transistor 34 will charge to one of two levels.

The reading of the data involves addressing both the vertical read grayscale line 18 and the horizontal read color line 22. Simultaneously addressing the read lines 18 and 22 turns on the vertical read transistor 36 and the horizontal read transistor 38, providing a conduction path from the storage transistor 34 to the read bit line (rbl) 24 while the conduction path to the write bit line (wbl) 12 is blocked by the transistor 32 which is turned "off" by a control signal to the write word line.

There is an array of dual port DRAM cells 10 in each pixel of an LCD. In the preferred embodiment, the number of such cells is equal to the number of bits in each segment of pixel data of a frame. For example, in an application in which a frame of pixel data includes eighteen bits per pixel (e.g., three colors and six bits of grayscale per color), each pixel of the LCD preferably has eighteen dual port DRAM cells. The series gating of the two read transistors 36 and 38 enables the selection of a particular dual port DRAM cell in a pixel. The ability to select a particular dual port DRAM cell is equivalent to the function of a conventional external decoder. Thus, an LCD with dual port DRAM cells does not need a separate decoder.

The physical design of the dual port DRAM cell permits writing of a word many bits wide into a row of dual port DRAM cells. This physical design also enables reading operations to take place while a write word line is accessed for a single writing operation. Thus, the reading operation is independent from the writing operations. The independent writing and reading feature enables the LCD with dual port DRAM cells to have a slow data input rate to match a variety of host systems, as well as a fast display rate to minimize flickers and display artifacts.

Figure 2:
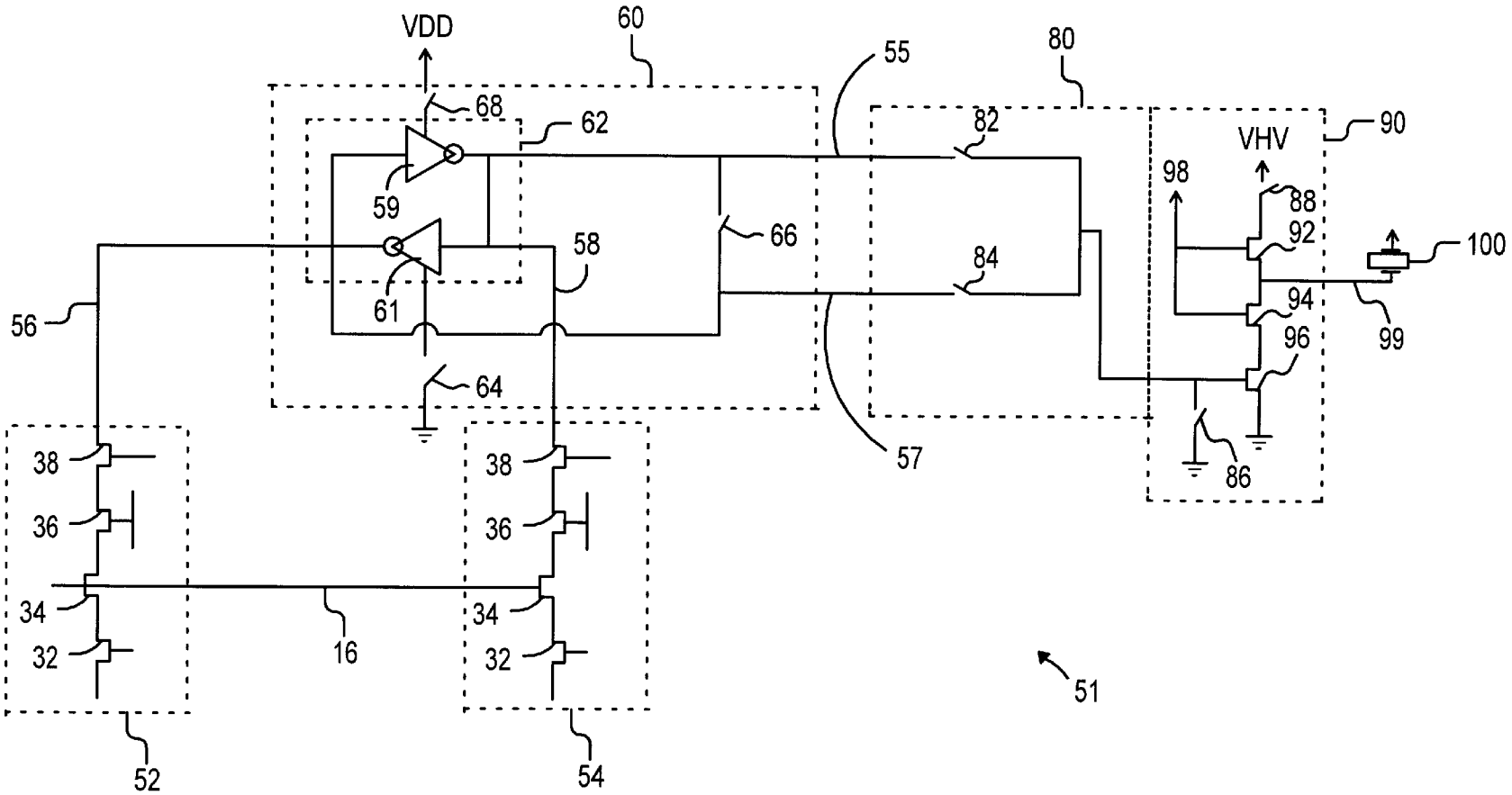
FIG. 2 is a schematic diagram of an eighteen-bit register pixel with a ½ V sensing scheme in accordance with the invention.

Turning to FIG. 2, a schematic diagram of an eighteen-bit register pixel 51 with a ½ V sensing scheme is shown. The eighteen-bit register pixel contains eighteen dual port DRAM cells of the type described with reference to FIG. 1. The DRAM cells are divided into a left array and a right array. The left array contains nine dual port DRAM cells, but is represented in FIG. 2 by a single dual port DRAM cell 52. The right array also contains nine dual port DRAM cells, but is represented by a single dual port DRAM cell 54. The left array is connected to a left read bit line 56, while the right array is connected to a right read bit line 58. A supply voltage line 16 (e.g., VDD) is connected to both dual port DRAM cells 52 and 54.

The read and write operations of the dual port DRAM cells 52 and 54 are identical to the operations of the dual port DRAM cell 10 in FIG. 1. If the dual port DRAM cell 52 is read, the data will appear at the left read bit line 56. Similarly, if the dual port DRAM cell 54 is read, the data will appear at the right read bit line 58. The read bit lines 56 and 58 are connected to sense amplifier circuitry 60.

Figure 6:
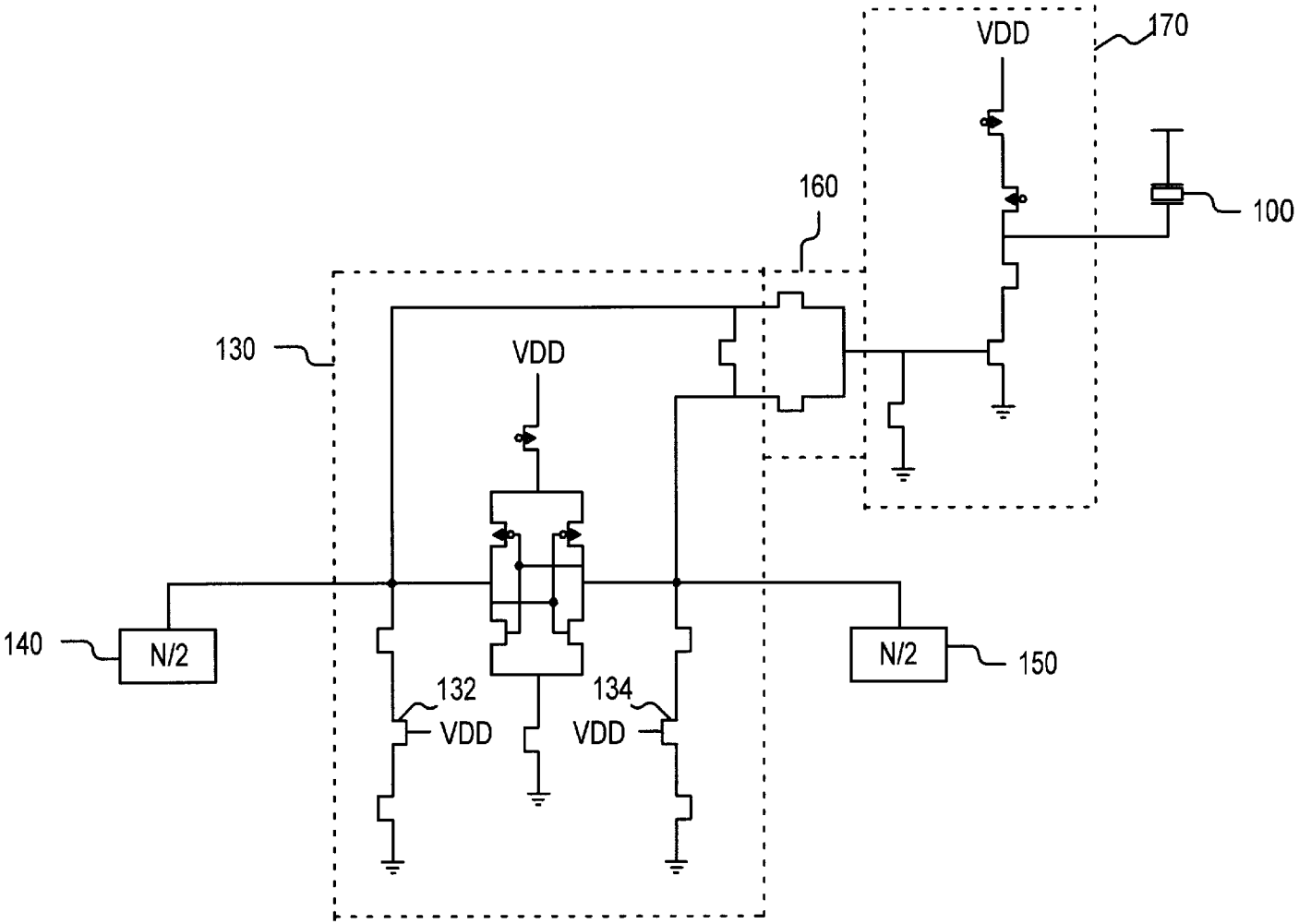
FIG. 6 is a schematic diagram of a 24-bit register pixel with a ½ C sensing scheme in accordance with the invention.

The sense amplifier circuitry 60 includes a sense amplifier 62 and three electrical switches 64, 66 and 68. Although the sense amplifier circuitry 60 utilizes a ½ V scheme, any conventional sense amplifier scheme, such as a ½ C scheme or a form of asymmetric sense amplifier, could be implemented. One output line 57 of the sense amplifier 62 is connected to the left read bit line 56, and the other output line 55 is connected to the right read bit line 58. The sense amplifier 62 is a cross coupled latch gated sense amplifier having two inverters 59 and 61 and may comprise two P-channel MOS transistors located on the upper portion of the sense amplifier 62 and two N-channel MOS transistors located on the lower portion of the sense amplifier 62 (as shown in FIG. 6). One of the P-channel transistors and one of the N-channel MOS transistors are connected in series from the switch 68 to the switch 64. The other two P-channel and N-channel MOS transistors are also connected in series from the switch 68 to the switch 64, so that parallel conduction paths are formed between the switches 64 and 68. The switch 64 provides a path from one end of the parallel conduction paths to ground, while the switch 68 connects the opposite end to VDD. The switch 66, when closed, electrically links the two output lines 55 and 57 of the sense amplifier 62.

The sense amplifier circuitry 60 is a dynamic circuit and requires a precise timing sequence. During an initial pre-charge state, the switch 66 is turned on, connecting the output lines 55 and 57 of the sense amplifier 62 to each other. The connection equalizes both sides of the sense amplifier 62 to approximately one-half of VDD, or 2.5 volts when the VDD is 5.0 volts. Then, the switch 66 is turned off, disconnecting the output lines of the sense amplifier 62. The sense amplifier 62 is now ready to receive a bit of pixel data.

At this point, one of the eighteen dual port DRAM cells of the register pixel 51 is selected to be read. The selected dual port DRAM cell could be located on the left array or the right array, such as cell 52 or cell 54. Depending upon the location and the bit of pixel data stored, the selected dual port DRAM cell will tend to pull the left read bit line 56 or the right read bit line 58 either low or high. Then, the switch 68 is closed, connecting the two P-channel MOS transistors of the sense amplifier 62 with VDD. After a short time delay, the switch 64 is closed, providing a conduction path from the two N-channel MOS transistors of the sense amplifier 62 to ground.

The imbalance between the two output lines 55 and 57 of the sense amplifier 62 caused by the bit of image data is amplified by the sense amplifier 62 to a signal swing. The swing of the sense amplifier 62 drives one output line of the sense amplifier to a high voltage (VDD) and the other output line to a low voltage (ground) in the direction of the memory cell that was read. The swing also causes the memory cell that was read to be refreshed or restored.

The swing of the sense amplifier 62 is also used to drive and refresh liquid crystal 100 of a particular pixel of the pixel array that forms the LCD. Depending upon the bit of pixel data that was sensed, one of the voltages on the output lines 55 and 57 is a true signal, representing the sensed bit of pixel data, and the other voltage is an inverted signal. The true signal is used to drive the liquid crystal 100, while the inverted signal is subsequently used to DC balance or refresh the liquid crystal 100.

The sense amplifier circuitry 60 is connected to DC balancing circuitry 80, which consists of two switches 82 and 84. During a display cycle in which the true signal is on the output line 55, the switch 82 is closed to allow the true signal to conduct to a liquid crystal driver 90. On the other hand, the switch 84 is closed during a subsequent DC balance cycle to allow the inverted signal to conduct through the DC balancing circuitry to reset the liquid crystal 100. Providing an inverted signal or DC balancing is required of most LCDs and is known in the art.

In the preferred embodiment, the liquid crystal 100 is a ferroelectric liquid crystal or a polar liquid crystal. The ferroelectric liquid crystal is favored over a twisted nematic liquid crystal, because the ferroelectric liquid crystal changes its state more quickly, allowing a higher quality display with a higher display frame rate or more bits of grayscale per display color.

Also shown in FIG. 2 is the liquid crystal driver 90 which is connected between the DC balancing circuitry 80 and the liquid crystal 100. The liquid crystal driver 90 is a conventional circuit and may consist of two switches 86 and 88 and three MOS transistors 92, 94 and 96. The VHV switch 88 and the three transistors 92, 94 and 96 are connected in series from VHV to ground. Gates of transistors 92 and 94 are coupled and connected to a voltage source 98. For example, the voltage source 98 may provide 2.5 volts to the gates of transistors 92 and 94. Connected between the transistors 92 and 94 is an output terminal 99 which leads to the liquid crystal 100.

A gate of transistor 96 provides the connection from the liquid crystal driver 90 to the DC balancing circuitry 80. Also connected to the gate of transistor 96 is the ground switch 86, which provides a conduction path from the gate of transistor 96 to ground.

Switches 86 and 88 are included in the liquid crystal driver 90 to allow a higher voltage to be reliably switched than would be normally allowed by MOS gate breakdown voltages dictated by the MOS process technology. For example, if a MOS technology is limited to a 3.3 V power supply, the FLCD drive voltage may be extended with this circuit to 5.0 V, when the power source 98 is 2.5 V. With the drive scheme of the liquid crystal driver 90, there are no MOS transistors that receive a gate voltage greater than the 3.3 V reliability limit. Extending the FLCD drive voltage in this manner allows the FLC material to receive a maximum drive voltage that translates into a faster FLC switching speed.

In order for the liquid crystal driver 90 to drive the liquid crystal 100, the switches 86 and 88 are closed during a driver precharge stage. The closing of switch 86 turns off the transistor 96 and drives the voltage low at the gate of transistor 96. The closing of switch 88 connects VDD to the output terminal 99, driving the voltage high on the output terminal 99. Once the output terminal 99 is charged high, the switches 86 and 88 are opened.

After a bit is read from one of the eighteen DRAM cells that include cells 52 and 54, either the true signal or the inverted signal is received from the DC balancing circuitry 80. Since the gate of transistor 96 was already precharged to a low voltage, if the received signal is low, the transistor 96 will remain in the "off" state. However, if the received signal is high, the voltage at the gate of transistor 96 will be pulled high, turning on the transistor 96. The activation of the transistor 96 provides a conduction path from the output terminal 99 to ground, which drives the voltage low on the output terminal 99. The voltage drop on the output terminal 99 drives the liquid crystal 100 to display the bit of pixel data or to refresh the liquid crystal 100.

In the preferred embodiment, all of the switches in FIG. 2 are semiconductor (MOS) transistors which are fabricated using a CMOS process. However, other electrical devices having "on" and "off" states could be utilized.

Figure 3:
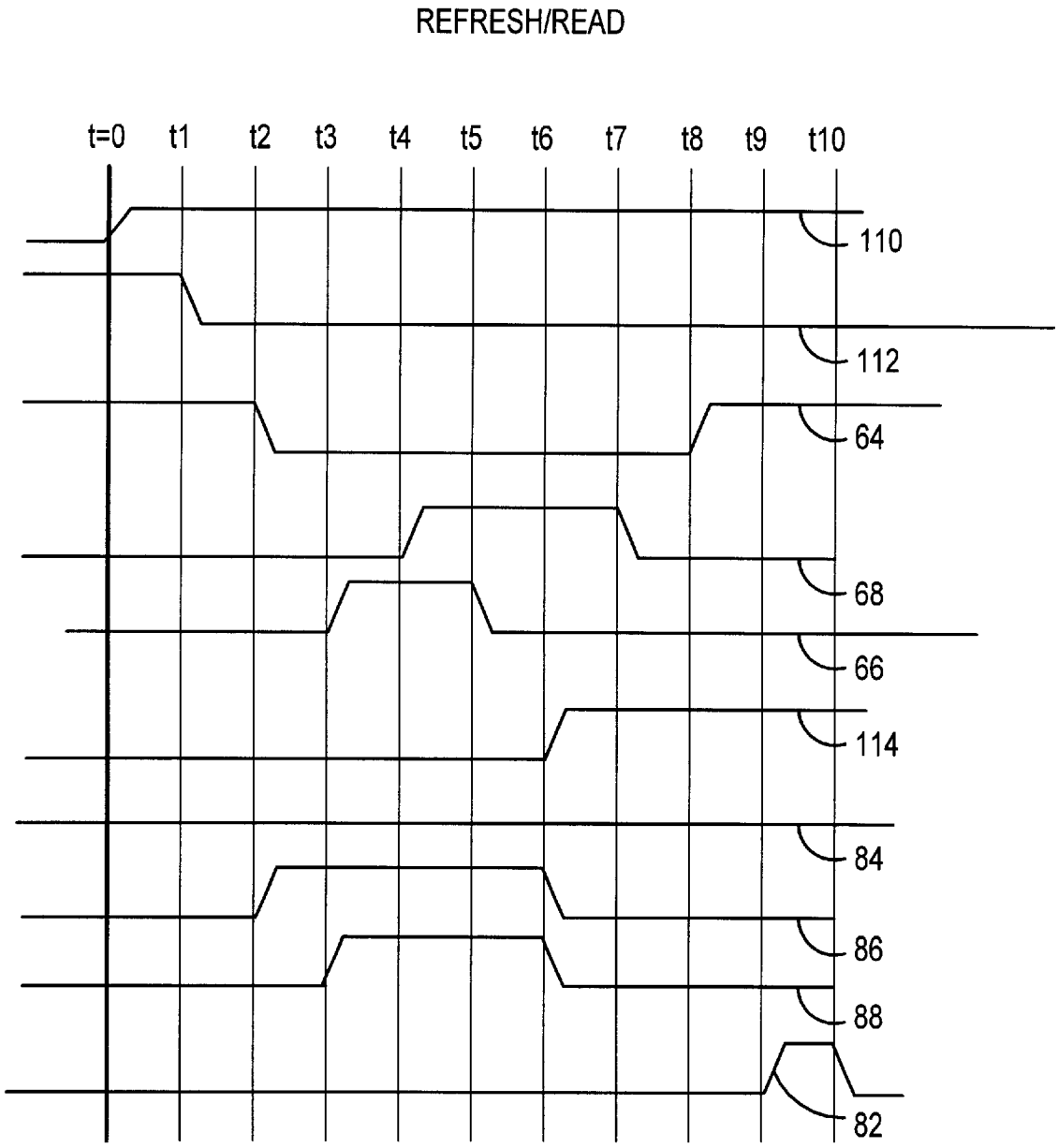
FIG. 3 is a refresh/read timing sequence for the eighteen-bit register pixel in accordance with the invention.

FIG. 3 shows a refresh/read timing sequence for the eighteen-bit register pixel 51 of FIG. 2. The reference numerals in FIG. 2 are used in FIG. 3 when referring to the same components. At t=0, a refresh clock 110 goes high and a dual port DRAM cell 112 that was read in a previous cycle is refreshed. At t=t1, refreshing the previous dual port DRAM cell 112 is completed. At t=t2, the switch 64 is opened, turning off the connection from the sense amplifier 62 to ground. In addition, the switch 86 is closed, connecting the gate of transistor 96 to ground. The effect of closing the switch 86 is to precharge the gate of transistor 96 to low. At t=t3, the switch 66 is closed, equalizing the two output lines 55 and 57 of the sense amplifier 62. The switch 88 is also closed at this time, precharging the output terminal 99 to high. At t=t4, the switch 68 is opened, turning off the connection from VDD to the sense amplifier 62. At t=t5, the switch 66 is opened to prepare for receiving a new bit of pixel data.

The read operation of the eighteen-bit register pixel 51 begins at t=t6. At this time, a dual port DRAM cell 114 is accessed. The switches 86 and 88 are opened, terminating the precharge stage for the liquid crystal driver 90. Upon accessing the DRAM cell 114, the imbalance of the sense amplifier 62 induced by the received bit of data causes the sense amplifier 62 to swing one of the output lines 55 and 57 of the sense amplifier 62 to VDD and the other output line to ground, depending on the value of the bit after the switches 64 and 68 are closed. At t=t7, the switch 68 is closed, turning on the connection from VDD to the sense amplifier 62. At t=t8, the switch 64 is closed, turning on the connection from the sense amplifier 62 to ground. At t=t9, the switch 82 is closed, connecting the sense amplifier 62 to the liquid crystal driver 90. Depending upon the bit of image data that was read from the dual port DRAM cell 114, the liquid crystal driver 90 either drives the output terminal 99 low, turning on the liquid crystal 100, or does not change the output terminal 99, leaving the liquid crystal 100 in the pre-charge high state in which the liquid crystal 100 was turned "off." Lastly, at t=t10 the switch 82 is opened, disconnecting the sense amplifier 62 from the liquid crystal driver 90, terminating the read operation.

Figure 4:
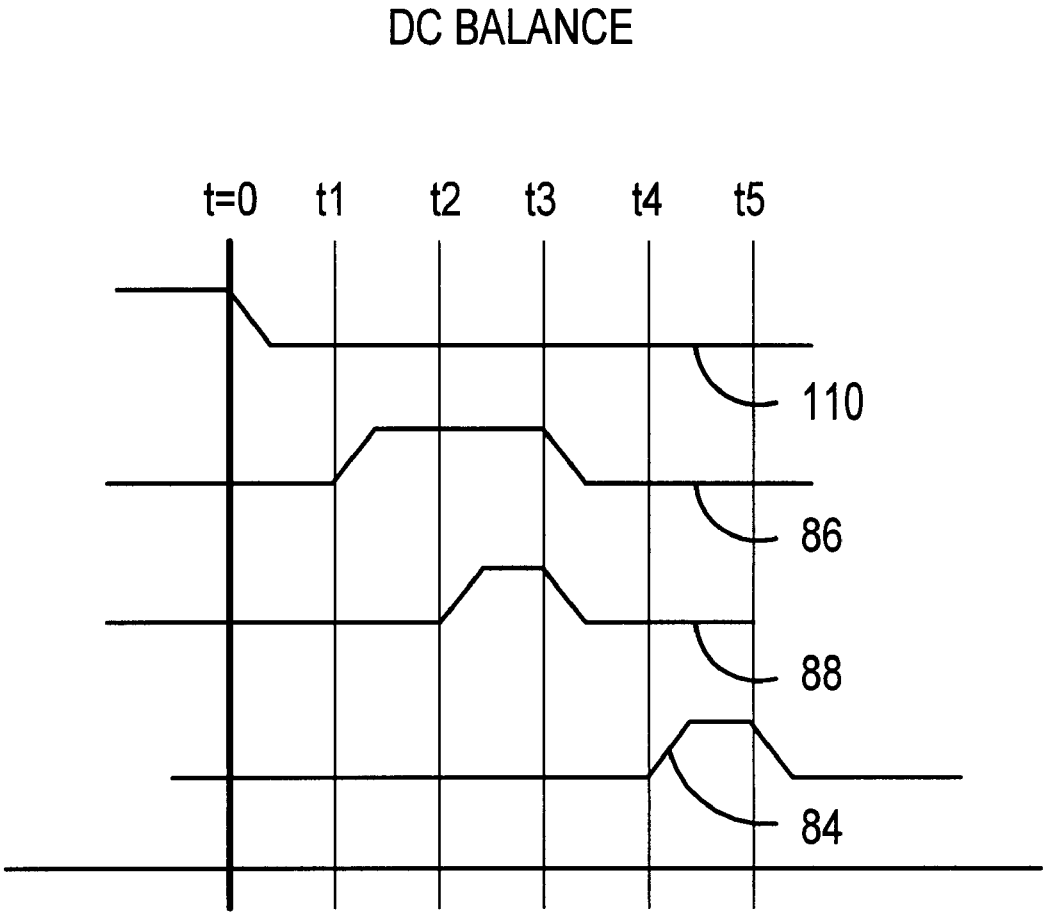
FIG. 4 is a DC balance timing sequence for the eighteen-bit register pixel in accordance with the invention.

In FIG. 4, a DC balance timing sequence is illustrated. Again, the reference numerals from FIG. 2 as well as from FIG. 3 are used when applicable. The operation of the eighteen-bit register pixel 51 with respect to the DC balance will be described with reference to FIGS. 2 and 4. At t=0, the refresh clock 110 is turned off. At t=t1, the switch 86 is closed, connecting the gate of transistor 96 to ground. Closing the switch 86 has the effect of precharging the gate of transistor 96 to low. At t=t2, the switch 88 is closed, charging the output terminal 99 to high. At t=t3, both switches 86 and 88 are opened, terminating the precharge stage of the liquid crystal driver 90. At t=t4, the switch 84 is closed, connecting the sense amplifier 62 to the liquid crystal driver 90. Depending upon the bit of pixel data that was previously read, the liquid crystal driver 90 sets the output terminal 99 low, turning "on" the liquid crystal 100, if the previous state of the liquid crystal 100 was off during the read timing sequence shown in FIG. 3, or does not change node 99, leaving the liquid crystal 100 in the pre-charge high state. Then at t=t5, the switch 84 is opened, isolating the sense amplifier 62 from the liquid crystal driver 90 and terminating the DC balance precharge and drive sequence.

Figure 5:
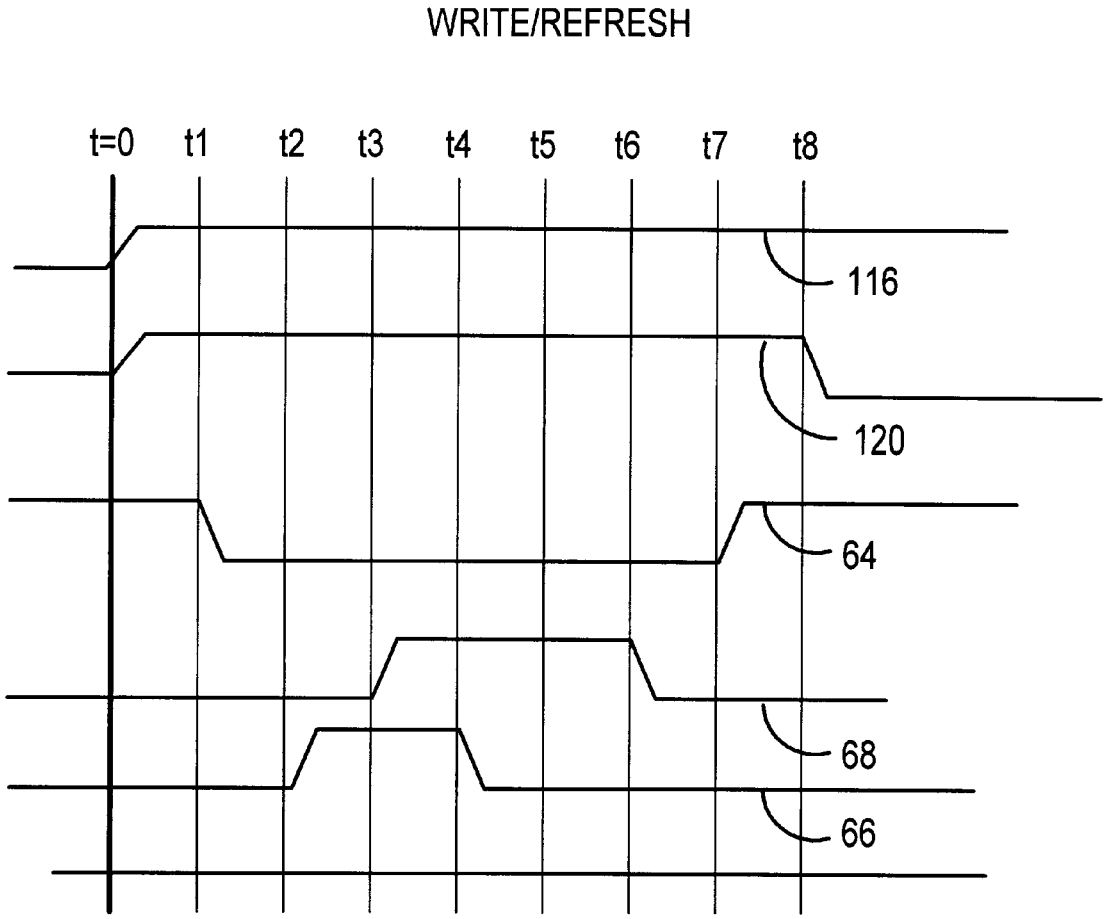
FIG. 5 is a write/refresh timing sequence for the eighteen-bit register pixel in accordance with the invention.

Turning to FIG. 5, a write/refresh timing sequence is shown. The write/refresh timing sequence is necessary to write new data from the write bit line 12 to the sense amp 62 through the pixel addressed by an active write word line 116. Again, the reference numerals from FIG. 2 as well as from FIG. 3 are used when applicable. The operation of the eighteen-bit register pixel 51 with respect to the write/refresh will be described with reference to FIGS. 2 and 5. At t=0, the write/refresh clock 120 is turned on and the single write word line (wwl) 116 is accessed. At t=t1, the switch 64 is opened, turning off the connection from the sense amplifier 62 to ground. At t=t2, the switch 66 is closed, equalizing the output lines 55 and 57 of the sense amplifier 62. At t=t3, the switch 68 is opened, turning off the connection from VDD to the sense amplifier 62. At t=t4, the switch 66 is opened to prepare for write/refresh operation. At t=t6, the switch 68 is closed turning on the connection from VDD to the sense amplifier 62. At t=t7, the switch 64 is closed, turning on the connection from the sense amplifier 62 to ground. At this time, a bit of pixel data is written or refreshed onto a single dual port DRAM cell. At t=t8, the write/refresh clock 120 is turned off.

Referring again to FIG. 1, because write bit line 12 is isolated from the read bit line 24, the read operations of the dual port memory cell 10 may occur at a frequency greater than the write operations. This has the advantage of allowing the write operations to be conducted at a rate that is compatible with a relatively slow host system, while the frequency of the read operations is selected to minimize flicker and display artifacts. Ideally, the frequency of write operations is reduced to zero when the display system electronically recognizes that consecutive frames of pixel data are identical for a significant period of time, such as when a laptop computer displays a portion of a word processing document for review by the user of the computer.

As shown in FIG. 1, the dual port memory cell 10 is comprised of the write access transistor 32 that is controlled by the write word line 14 to connect the write bit line 12 to a storage device, such as a large gate area transistor 34 with its gate connected to a fixed voltage (VDD) to invert the surface of the silicon and to function as a storage capacitor. The dual port memory cell also includes two series-connected read transistors 36 and 38, with the first read transistor being controlled by a read_grayscale signal along line 18 and the second transistor controlled by a read_color signal along line 22. The storage device 34 is connected to the read bit line 24 only when both of the read transistors 36 and 38 are activated. The physical design of the memory cell allows for writing a word that is many bits wide (e.g., six or eight bits) into a row of memory cells with one write word line access as a write operation, while independent read operations occur. Each independent read operation occurs as a unique combination of read_grayscale and read_color signals to read a single bit within a particular pixel in the array of pixels for the display device. However, the same combination of read_grayscale and read_color signals reads the corresponding bit from every pixel in the pixel array. If the total number of bits to be read is equal to X, the preferred embodiment is one in which the number of dual port memory cells is equal to X and the read operations of cells follow the same sequence for all of the pixels. The process of sequentially reading the cells in a particular array enables the functions of sampling and refreshing the stored data on the dynamic storage nodes and supplies display data to the driver circuitry for the time sequential construction of the image that is displayed.

The size of the pixels and the arrangement of pixels are not critical to the invention. Fabricating memory cell arrays as described above may be implemented into a VGA array (i.e., 640×480 pixel array) in a 0.35 $\mu$m CMOS process, or even a QGA array (i.e., 1280×960 pixel array) in a 0.18 $\mu$m CMOS process.

FIG. 6 is a schematic diagram of a 24-bit register pixel (i.e., N=24), with a ½ C sensing scheme. The 24-bit register pixel is very similar to the eighteen-bit register pixel 51 of FIG. 2. There are only two major differences. Apparent from the name, the 24-bit register pixel has six additional dual port DRAM cells. Since the 24-bit register pixel also has a left memory array 140 and a right memory array 150, the six additional cells are distributed equally between the memory arrays 140 and 150. Therefore, the memory arrays 140 and 150 each contain twelve dual port DRAM cells. The other major difference between the 24-bit and the eighteen-bit register pixel is the sense amplifier scheme. The sense amplifier circuitry 60 (FIG. 2) in the eighteen-bit register pixel utilizes a ½ V sensing scheme. The 24-bit register pixel shown in FIG. 6 utilizes a ½ C sensing scheme for the sense amplifier circuitry 130. As stated above, the type of sensing scheme utilized is not crucial to the invention.

All of the switches described with reference to FIG. 2 are shown in FIG. 6 as transistors and the sense amplifier within the sense amplifier circuitry 130 is illustrated in detail, also with transistors. However, these transistors function in the same manner as the corresponding components described in reference to the eighteen-bit register pixel. Thus, the difference is only in form and not of content.

Identical to the eighteen-bit register pixel, the left memory array 140 is connected to one side of the sense amplifier circuitry 130 and the right memory array 140 is connected to the other side. The sense amplifier circuitry 130 is connected to DC balance circuitry 160, which is identical to the DC balance circuitry 80. A liquid crystal driver 170 is connected to the balance circuitry 160. Again, the liquid crystal driver 170 is identical to the liquid crystal driver 90 in FIG. 2. The liquid crystal driver is connected to the liquid crystal 100.

The 24-bit register pixel operates in a very similar manner to the eighteen-bit register pixel. The only difference is in the operation of the sense amplifier circuitry 130 compared to the sense amplifier circuitry 60 in FIG. 2. The sense amplifier circuitry 130 utilizes a ½ C scheme, using two dummy memory cells 132 and 134, instead of the ½ V scheme of the sense amplifier circuitry 60. The ½ C scheme for a sense amplifier is known in the art. The difference in scheme, however, does not affect the function of the sense amplifier circuitry 130. The sense amplifier circuitry 130 also detects an imbalance caused by a bit of pixel data when a particular dual port DRAM cell is read and swings one output of the sense amplifier to high voltage and the other side to low voltage. The high and low signal is sent to the liquid crystal driver 170 through the DC balance circuitry 160 to drive the liquid crystal 100 in the same manner as described above for the eighteen-bit register pixel 51.

Although only the eighteen-bit register pixel and the 24-bit register pixel are describe herein, other pixel designs using the dual port DRAM cells and other components of the eighteen-bit and the 24-bit register pixels are contemplated. The number of dual port DRAM cells that could be fabricated on a single pixel is only limited by the chip manufacturing technology. Therefore, additional dual port DRAM cells can be placed in a single pixel to yield a variety of register pixels such as 36-bit, 48-bit and 64-bit register pixels.

Figure 7:
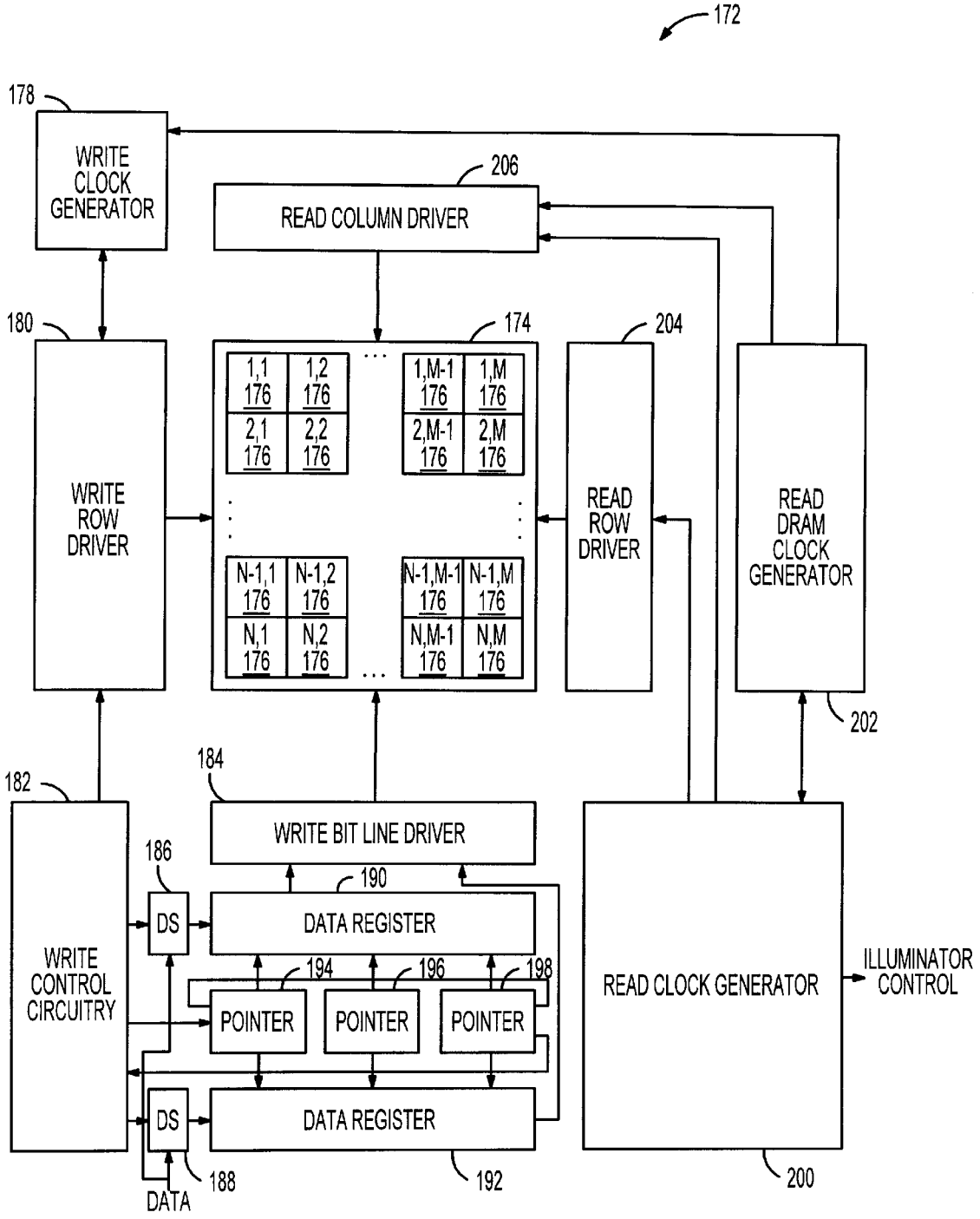
FIG. 7 is a block diagram of an integrated display device incorporating the memory cell of FIG. 1.

Turning to FIG. 7, a block diagram of an integrated display device 172 is shown. Positioned in the center of the integrated display 172 is a matrix 174 of pixels 176. The pixels 176 can be the same type illustrated in either FIG. 2 or FIG. 6. However, the integrated display device 172 will be described here as having eighteen-bit register pixels, as in the embodiment of FIG. 2. The matrix 174 contains N×M pixels 176. The integrated display device 172 can be a VGA display, in which case 307,200 pixels 176 are contained in the matrix 174. However, the number of pixels 176 in the matrix 174 is not crucial to the invention.

The components of the integrated display device 172 that are primarily associated with the writing operation include a write clock generator 178, a write row driver 180, write control circuitry 182, a write bit line driver 184, and frame buffer circuitry. The frame buffer circuitry is comprised of data switches (DS) 186 and 188, data registers 190 and 192, and pointers 194, 196 and 198.

The write clock generator 178 provides write clock signals to the write row driver 180. Using the write clock signals, the write row driver 180 addresses write word lines within the matrix 174 to activate the write transistors of memory cells that are electrically connected to the addressed write word lines. The gates of write transistors within each row of pixels 176 in the matrix 174 are connected to one of three write word lines. Therefore, the matrix 174 contains N×3 write word lines. The write word lines are addressed one at a time by the write row driver 180. The write row driver 180 sends a signal to turn "on" the write transistors controlled by a particular write word line. By addressing one write word line at a time, all the write transistors of memory cells in the matrix 174 can be addressed. The write row driver 180 can be configured sequentially to access the write word lines in a forward direction, i.e., from bottom to top of the matrix 174, or in the reverse direction. The control signals for the forward or reverse direction are provided by the write control circuitry 182. The write control circuitry 182 also provides control signals to the data switches 186 and 188.

The data switches 186 and 188 direct streams of digital image data from an external source to either the data register 190 or data register 192. A single stream of digital image data is defined here as a portion of a frame of image data for an entire row of pixels 176 in the matrix 174. Therefore, a stream of digital image data is composed of M number of multi-bit pixel data, since there are M pixels for each row of pixels in the matrix 174. Each multi-bit pixel data includes eighteen bits, containing three color and six-bit grayscale information for each color. The data switches 186 and 188 operate to direct a single stream of digital image data to one of the two data registers 190 and 192 for temporary storage, during a period when the other data register is transferring a previously-stored stream of digital image data to the write bit line driver 184 in order to write the previously-stored stream of digital image data into a designated row of pixels 176. The receiving and transferring functions are accomplished in an alternating fashion by the data registers 190 and 192. That is, a first data register receives and stores a first stream of digital image data, while the second data register transfers a second stream of digital image data, that had been temporarily stored in the second data register during the previous cycle, into a row of pixels. When finished, the first data register transfers the first stream of digital image data to the write bit line driver 184, while the second data register receives and stores a third stream of digital image data. This cycle is repeated until an entire frame of digital image data is transferred to the write bit line driver 184, and consequently to the pixels 176 in the matrix 174.

The data registers 190 and 192 each contain N register circuits, that can store a stream of digital image data, i.e., image data for an entire row of pixels 176 in the matrix 174. A single register circuit contains eighteen dual port register cells for storing multi-bit pixel data. The pointers 194, 196 and 198 control the signals for the write and read ports of the dual port register cells within the data registers 190 and 192. The write bit line driver 184 operates to relay the stream of digital image data transferred from either the data register 190 or 192 to a row of pixels 176 in the matrix 174. The operation of the frame buffer circuitry will be described in greater detail below.

The read operation of the integrated display device 172 is primarily performed by a read clock generator 200, a read DRAM clock generator 202, a read row driver 204, and a read column driver 206. The read clock generator 200 provides signals to the read DRAM clock generator and the read drivers 204 and 206. The read clock generator 200 also provides an illuminator control signal to external circuitry (not shown) in order to coordinate the external color illumination with the internal controls of color select and DC balance. The external color illumination may consist of red, green and blue colors. The read clock generator 200 may be programmed to operate with a time modulation sequence, an intensity modulation sequence, or a combination of time sequence and intensity sequence for displaying images on the matrix 174. The read row driver 204 controls the horizontal read transistors in each of the memory cells in the pixels 176 of the matrix 174, while the read column driver 206 controls the vertical read transistors. The read DRAM generator 202 provides signals for the dynamic operations of the sense amplifier circuitry, the DC balancing circuitry, and the liquid crystal driver within each of the pixels 176 in the matrix 174.

Figure 8:
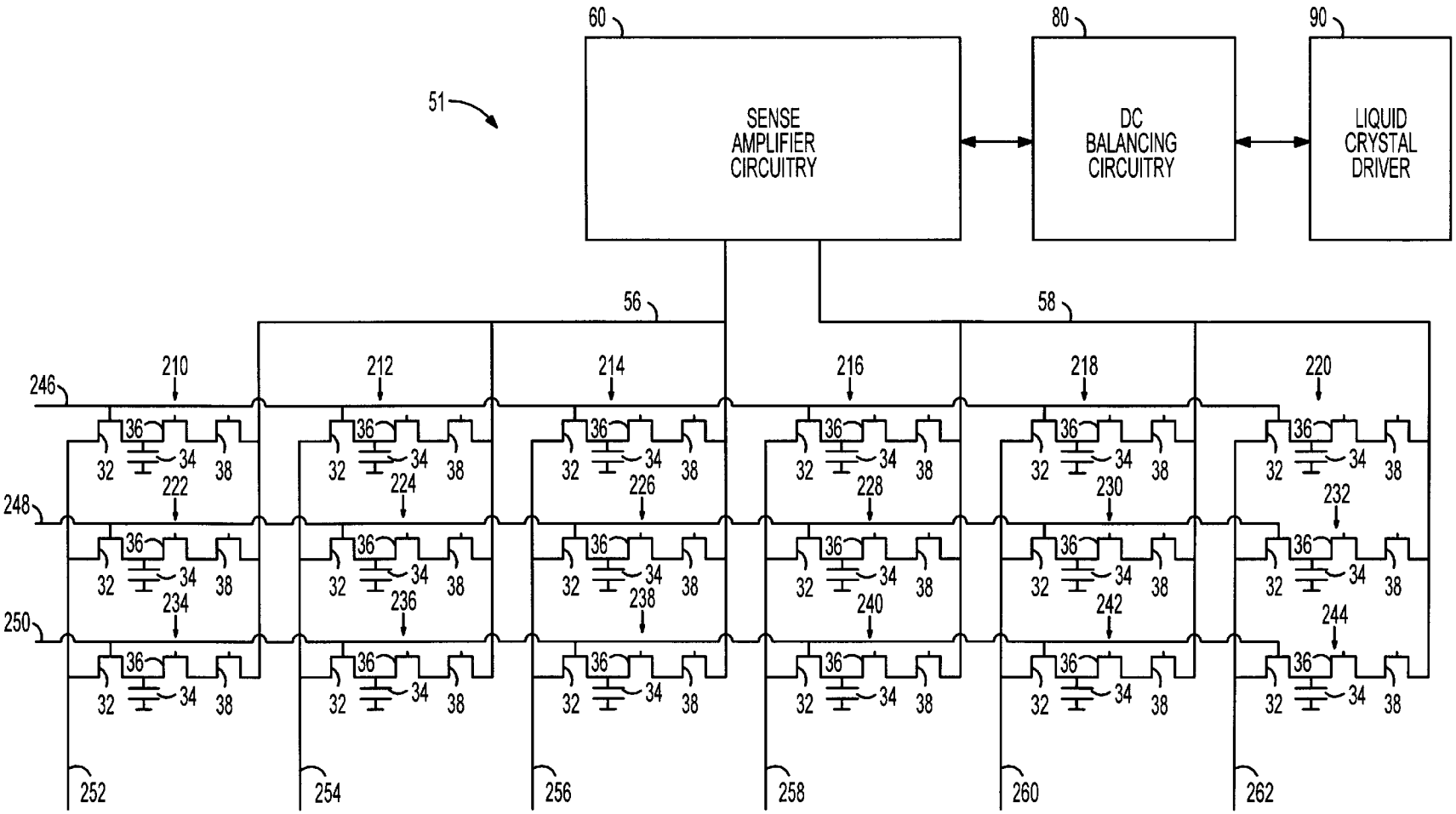
FIG. 8 is a schematic diagram of the eighteen-bit register pixel of FIG. 2, including illustration of all eighteen memory cells with connections to write word lines.

With reference to FIG. 8, the register pixel 51 of FIG. 2 illustrating all eighteen dual port DRAM cells is shown. When appropriate, the same reference numerals utilized in FIG. 2 will be used. For simplicity, the sense amplifier circuitry 60, the DC balancing circuitry 80, and the liquid crystal driver 90 are shown as blocks. In addition, the storage transistors 34 are illustrated as capacitors for easy identification. The register pixel 51 in FIG. 8 will be used to describe the write operation of the integrated display device 172 of FIG. 7.

A first row of memory cells within the pixel 51 is defined by DRAM cells 210, 212, 214, 216, 218 and 220. The second row of memory cells is defined by DRAM cells 222, 224, 226, 228, 230 and 232. Lastly, the third row of memory cells is defined by cells 234, 236, 238, 240, 242 and 244. The columns of memory cells are defined by the cells 210, 222 and 234, cells 212, 224 and 236, etc. The register pixel 51 is designed to store eighteen bits of data representing the colors red, green, and blue, and their associated six-bit grayscale. For example, the first row may be designated to store six bits of data for the color blue. Similarly, the second row can store six bits for the color green, while the third row is able to store six bits for the color red.

Each of the cells 210–244 is connected to either the left read bit line 56 or the right read bit line 58. In addition, each column of memory cells is connected to a write bit line. The first column of cells 210, 222 and 234 is connected to a write bit line 252. The second column of cells 212, 224 and 236 is connected to a write bit line 254. Similarly, the third column of cells 214, 226 and 238 is connected to a write bit line 256. The fourth column of cells 216, 228 and 240 is connected to a write bit line 258. Likewise, the fifth column of cells 218, 230 and 242 is coupled to a write bit line 260. The sixth column of cells 220, 232 and 244 is connected to a write bit line 262.

The write transistors 32, which control the write ports of the cells 210–244, are connected to one of three write word lines 246, 248 and 250. The gates of write transistors 32 of the cells 210–220 in the first row of memory cells are electrically connected to the write word line 246. Similarly, the gates of write transistors 32 of the cells 222–232 in the second row of memory cells are connected to a write word line 248. A write word line 250 is connected to the gates of write transistors 32 of the cells 234–244 in the third row of memory cells.

During the write operation, a signal level from the write row driver 180, shown in FIG. 7, is sent through one of the write word lines 246, 248 and 250, turning "on" all the write transistors 32 in a row of cells. For example, if a digital word representing the color red is being stored into the pixel 51, an activation signal will be applied to the write word line 250, turning "on" the write transistors 32 of cells 234–244. In addition, a digital word of six bits is sent through the write bit lines 252–262 by the write bit line driver 184, such that a single bit of data is present on a single write bit line. The digital word is written into the pixel 51 in a parallel manner. When the word has been written into the third row of memory cells 234–244, the activation signal is taken away from the write word line 250 and an activation signal can be applied to the write word line 248 to write into the second row of memory cells 222–232. In this manner, an entire multi-bit pixel data can be written into the pixel 51, a row of memory cells at a time.

On a larger scale, an entire frame of digital image data can be written into the matrix 174 by simultaneously writing M digital words into a row of memory cells in a row of pixels 176, N×3 times. Initially, a first stream of digital image data is received by the data switch 188. The write control circuitry 182 controls the data switch 188 to direct the stream of digital image data to the data register 192. Alternatively, the data switch 186 may direct the stream of digital image data to the data register 190. The data stream is comprised of eighteen-bit packets, each eighteen-bit packet containing all the image data for a single pixel 176 in the matrix 174. A single eighteen-bit packet contains three six-bit words for each of the three colors, red, green, and blue.

After the data register 192 is filled with M×3 digital words, i.e., image data for an entire row of pixels 176 in the matrix 174, the data switch 188 stops directing data to the data register 192. The data switch 186 begins to direct the next stream of digital image data to the data register 190. Meanwhile, the data register 192 begins to transfer all digital words for a single color to the write bit line driver 184 in order to write into a row of pixels 176 in the matrix 174. If the integrated display device 172 is configured for the forward direction, i.e., the upward direction from the bottom of the matrix 174 to the top of the matrix 174, these digital words would represent data for the color red for the bottom row of pixels 176 in the matrix 174. The write bit line driver 184 then amplifies the signals for the digital words and relays them to the bottom row of pixels 176 through M×6 write bit lines in a parallel manner. There are M×6 write bit lines because each column of pixels 176 in the matrix 174 has six write bit lines. The six write bit lines are common for all the pixels in that column of pixels 176. Concurrently, the write row driver 180 sends a signal to the write word line, that corresponds to the row of memory cells for the color red in the bottom row of pixels 176 in the matrix 174.

The storing and transferring operations of the data registers 190 and 192 are synchronized by the pointers 194,196 and 198. The pointers 194–198 operate to ensure that, when the data register 192 has transferred all the digital words for the color red, i.e., a third of the data stored in the data register 192, the register 190 has stored a third of the data for the next row of pixel 176 in the matrix 174. The pointers 194–198 continue to operate in a similar fashion for the color green such that, when the data register 192 has also transferred the digital words associated with the color green, the data register 192 has store two thirds of the data that is being received. The synchronization by the pointers 194–198 continues for the color blue. The pointers 194–198 also provide information to the write control circuitry 182 to control the write row driver 180 in order for the write row driver 180 to supply a signal to the next write word line, or to "step up." The "step up" occurs when the digital word for a single color has been written into the appropriate row of memory cells in a row of pixels 176.

After the data from the data register 192 has been written into a row of pixels 176, the data switches 186 and 188 operate to begin directing the next stream of digital image data to the data register 192, while the stored data in the data register 190 is written into the next row of pixels. In this manner, a frame of digital image data is written into the matrix 174 of the integrated display device 172.

Figure 9:
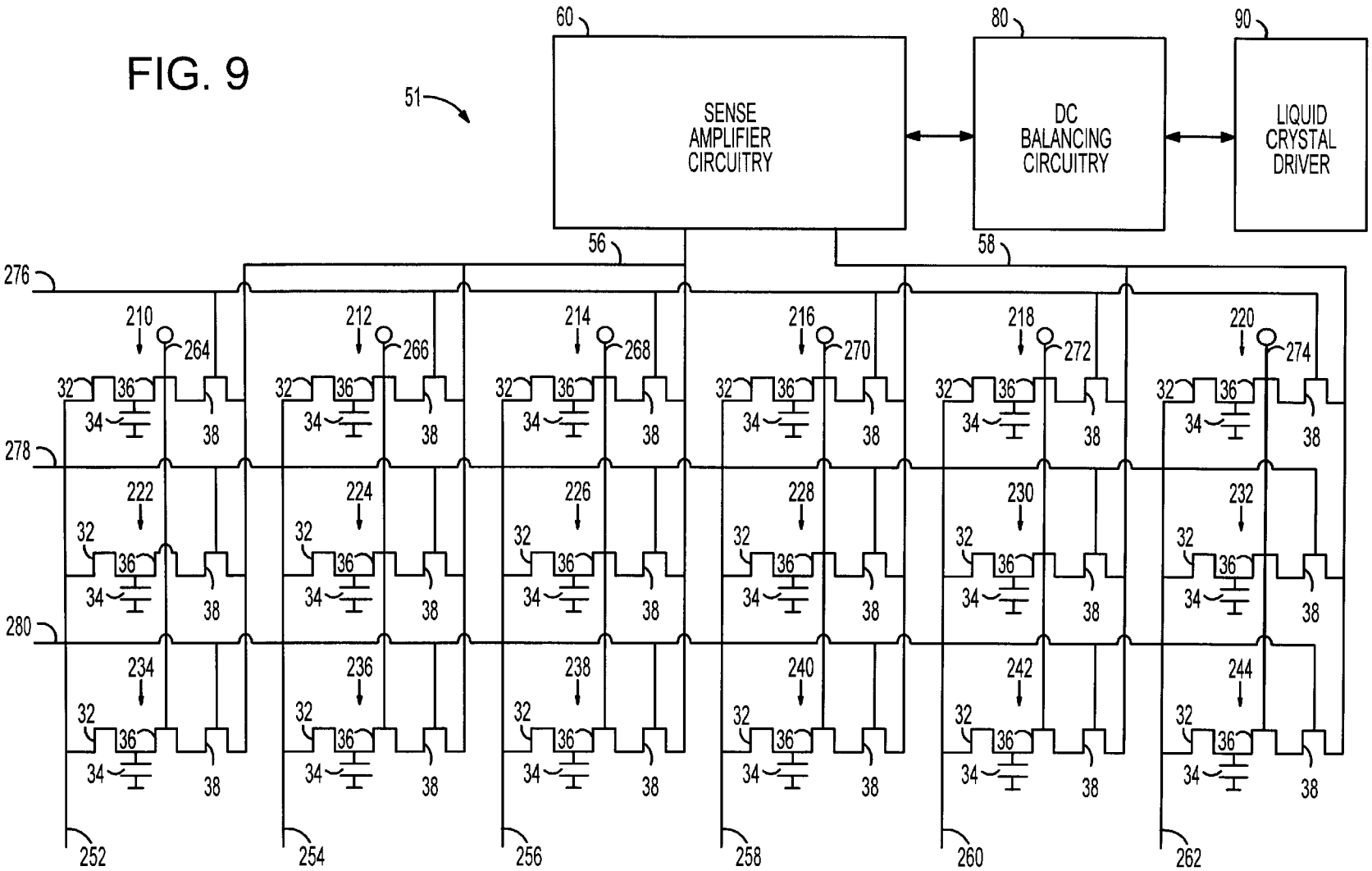
FIG. 9 is a schematic diagram of the eighteen-bit register pixel of FIG. 8, including connections to grayscale lines and color lines.

Turning to FIG. 9, the same register pixel 51 of FIG. 8 is shown with connections to the vertical read transistors 36 and the horizontal read transistors 38. The write word lines 246, 248 and 250 have been deleted for simplification. The gates of vertical read transistors 36 in the memory cells 210–244 are connected to one of six grayscale lines. The gates of vertical read transistors 36 of the first column of cells 210, 222 and 234 are connected to a grayscale line 264. The gates of vertical read transistors 36 of the second column of cells 212, 224 and 236 are connected to a grayscale line 266. Similarly, the gates of vertical read transistors 36 of the third column of cells 214, 226 and 238 are connected to a grayscale line 268. The gates of vertical read transistors 36 of the fourth column of cells 216, 228 and 240 are coupled to a grayscale line 270, while the gates of vertical read transistors 36 of the fifth column of cells 218, 230 and 242 are connected to a grayscale line 272. Lastly, the gates of vertical read transistors 36 of the sixth column of cells 220, 232 and 244 are connected to a grayscale line 274.

The gates of horizontal read transistors 38 of the memory cells 210–244 are coupled to one of three color lines 276, 278 and 280. The gates of horizontal read transistors 38 of the first row of cells 210–220 are connected to the color line 276, while the gates of horizontal read transistors 38 of the second row of cells 222–232 are coupled to the color line 278. The gates of horizontal read transistors 38 of the third row of cells 234–244 are connected to the color line 280. By applying voltages to a grayscale line and a color line, a bit of data stored in one of the memory cells 210–244 can be read. For example, to read the data stored in the memory cell 210, activation voltage levels are applied to the grayscale line 264 and the color line 276. The voltages turn "on" transistors 36 and 38, allowing the data to be read through the left read bit line 56.

On a larger scale, the matrix 174 contains M×6 grayscale lines. A set of six grayscale lines is common to all the pixels 176 in the entire matrix 174. Similarly, there are M×3 color lines. A set of three color lines are common to all the pixels 176 in the entire matrix 174. The read operation is performed such that when a particular memory cell in a pixel 176 is accessed for reading, a corresponding memory cell in each of the pixels 176 in the matrix is accessed.

In order to read all eighteen bits stored in each of the pixels 176, the memory cells 210–244 may be read in any sequence. However, a potential problem exists when accessing the memory cells 210–244 in a random manner. Addressing the vertical and horizontal read transistors 36 and 38 of a memory cell in an alternating fashion may store a capacitance charge between the read transistors 36 and 38 of that memory cell. The capacitance charge is a charge that is trapped between the read transistors 36 and 38 of a memory cell when reading other memory cells. The capacitance charge may degrade the data stored in that memory cell when that stored data is exposed to the capacitance charge. For example, the memory cell 210 may have a "1" stored in the storage transistor 34, represented by a 1.5 V charge stored in the storage transistor 34. If the color line 276 is addressed to turn "on" the horizontal transistor 38 in order to read a "0" in another memory cell connected to the left read bit line 56, a voltage of zero will be trapped between the read transistors 36 and 36 of the cell 210. Furthermore, if the vertical read transistor 36 is addressed to access another memory cell connected to the grayscale line 264, turning "on" the vertical read transistor 38, the 1.5 V charge stored in the storage transistor 34 of the memory cell 210 will degrade to approximately 1.3 V when electrically connected to the trapped voltage. If the read transistors 36 and 38 are repeatedly addressed in a similar manner, the "1" that was stored in the storage transistor 34 of the memory cell 210 may be degraded to such a degree that it may be mistakenly read as a "0" when the memory cell 210 is accessed.

Figure 10:
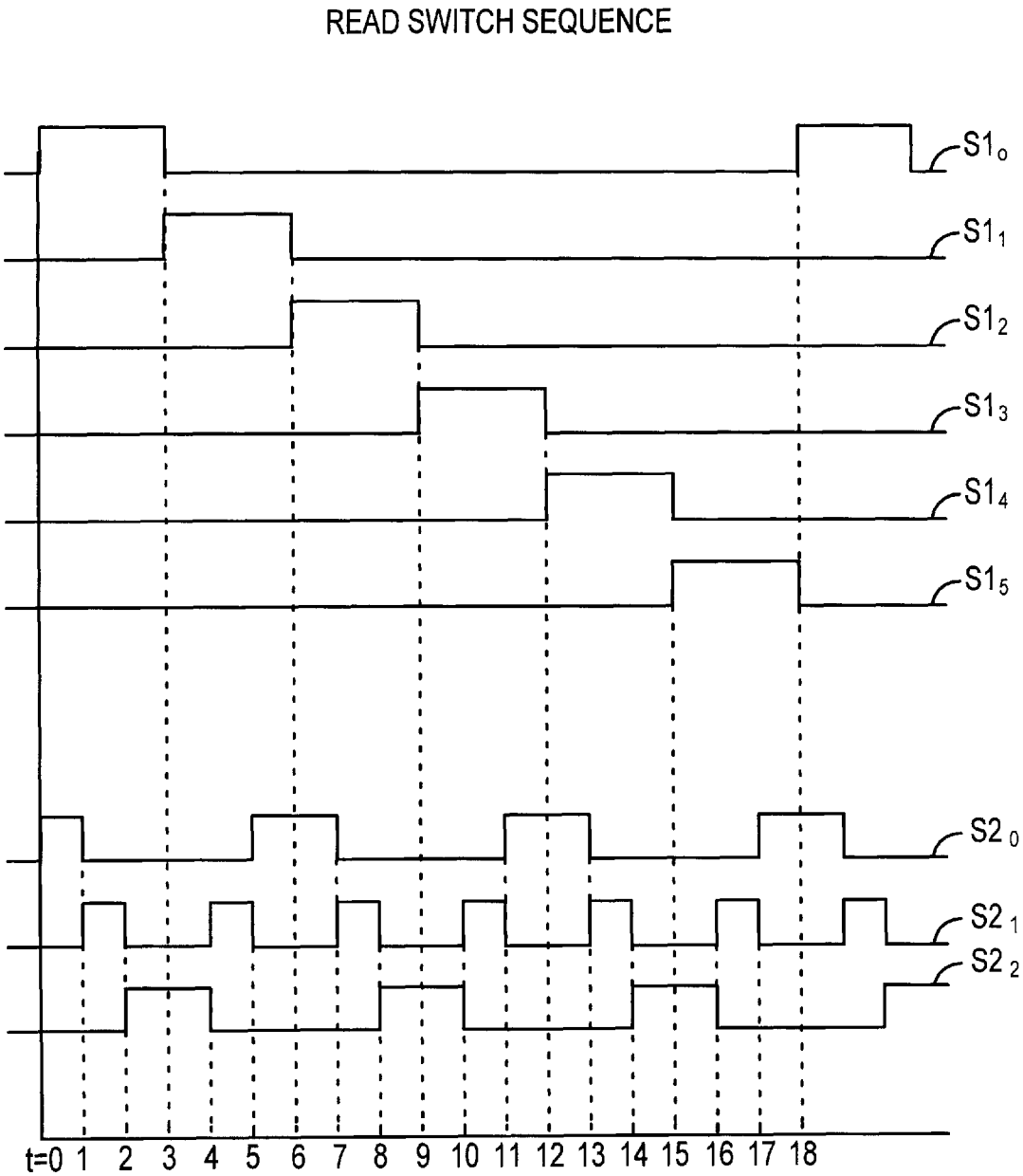
FIG. 10 is a read switch sequence for the eighteen-bit register pixel to minimize potential data degradation.

In order to prevent the above-described potential data degradation, a read sequence can be selected to minimize exposure to a capacitance charge within each of the dual port memory cells 210–244 between the vertical read transistor 36 and the horizontal read transistor 38. A read timing sequence that has taken into account the potential data degradation is illustrated in FIG. 10. The read timing sequence of FIG. 10 will be described with references to FIGS. 7 and 9. The top six signals in FIG. 10 represent pulses that are applied to the grayscale lines 264–274. Signals $S1_0$, $S1_1$, $S1_2$, $S1_3$, $S1_4$ and $S1_5$ are signals that are applied to the grayscale lines 264, 266, 268, 270, 272 and 274, respectively. The lower three signals represent pulses that are applied to the color lines 276–280. Signals $S2_0$, $S2_1$ and $S2_2$ are signals that are applied to the color lines 276, 278 and 280, respectively. The signals $S1_0$–$S1_5$ and $S2_0$–$S2_2$ are supplied by the read clock generator 200. The period t=0 to t=18 represents one read cycle.

During the period t=0 to t=3, the signal $S1_0$ is high, turning "on" the vertical read transistors 36 of memory cells 210, 222 and 234. During the same period, the horizontal read transistors 38 of memory cells 210, 222 and 234 are addressed sequentially. Between t=0 and t=1, the signal $S2_0$ turns "on" the horizontal read transistor 38 of memory cell 210, accessing the data stored in the memory cell 210. Similarly, between t=1 and t=2, the signal $S2_1$ turns "on" the horizontal read transistor 38 of memory cell 222, accessing the data stored in the memory cell 222. Lastly, during t=2 to t=3, the signal $S2_2$ turns "on" the horizontal read transistor 38 of memory cell 234, accessing the data stored in the memory cell 234. At t=3, the signal $S1_0$ drops, which turns "off" the vertical read transistors 36 of memory cells 210, 222 and 234. During t=3 to t=6, signal $S1_1$ is high, turning "on" the vertical read transistors 36 of memory cells 212, 224 and 236. Between t=3 and t=6, the color lines 276–280 are again addressed sequentially by the signals $S2_0$–$S2_2$. In a similar manner, all of the memory cells 210–244 are sequentially read during t=0 to t=18.

The important feature of the read sequence of FIG. 10 is that during one read cycle, i.e., t=0 to t=18, each vertical read transistor 36 of memory cells 210–244 is turned "on" only once. Thus, the potential data degradation can occur only once during a read cycle, ensuring that the data will not be degraded to a degree such that the data will be read erroneously. The effect of turning "on" the vertical read transistor during a following read cycle is inconsequential because of the full refresh feature of the register pixel 51. That is, because the memory cells are simultaneously read and refreshed, any data degradation during a first read cycle will have been compensated before the next read cycle, since each memory cell is read and refreshed once during a read cycle.

Figure 11:
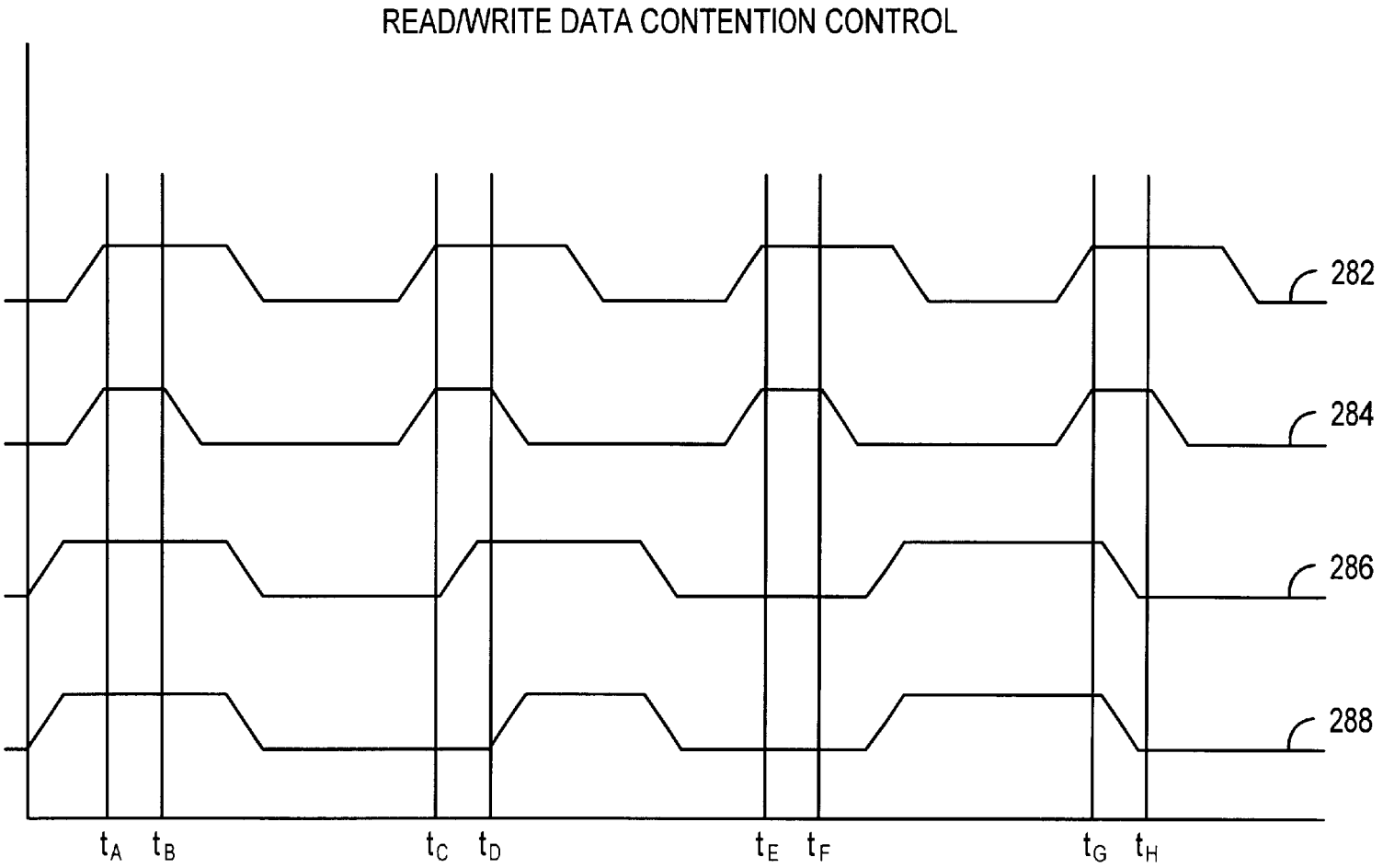
FIG. 11 is a data contention control timing sequence to prohibit read/write data contention.

Another concern involving the read operation of the integrated display device 172 is a read/write data contention. The integrated display device 172 allows independent read and write operations. However, the memory cells within the pixels 176 of the matrix 174 cannot be simultaneously addressed to write into and read from the same memory cell. The data contention can be resolved by holding off a write sequence during an active reading period. Relevant signals for the issue of data contention are illustrated in FIG. 11. Signal 282 is a read clock control (rclk) signal that is provided by the read clock generator 200, shown in FIG. 7. Signal 284 is a read/refresh control (rrclk) signal that is generated from the rclk signal 282 by the read DRAM clock generator 202. Signal 286 is an external write clock control (ewclk) signal that is received by the write control circuitry 182 from external circuitry. The last signal 288 is a modified write clock control (mwclk) signal that actually controls the write operations of the integrated display device 172. The mwclk signal 288 is generated from the rrclk signal 284 and the ewclk signal 286 is generated by the write clock generator 178.

The critical times for data contention are those when the read/refresh control signal 284 is high. Therefore, the critical periods are between $t_A$ and $t_B$, $t_C$ and $t_D$, $t_E$ and $t_F$, and $t_G$ and $t_H$. The data contention can occur if the rising edge of ewclk signal 286 coincides with one of the critical periods. As shown in FIG. 11, the only period when the rising edge of ewclk signal 286 coincides with the critical period is during $t_C$ and $t_D$. During this period, the write operation is prohibited by delaying the mwclk signal 288 until the critical period is over. During other times, the mwclk signal 288 is identical to the ewclk signal 286, allowing the write operation to proceed. By prohibiting the write operation in the described manner, write/read data contention is avoided.

Figure 12:
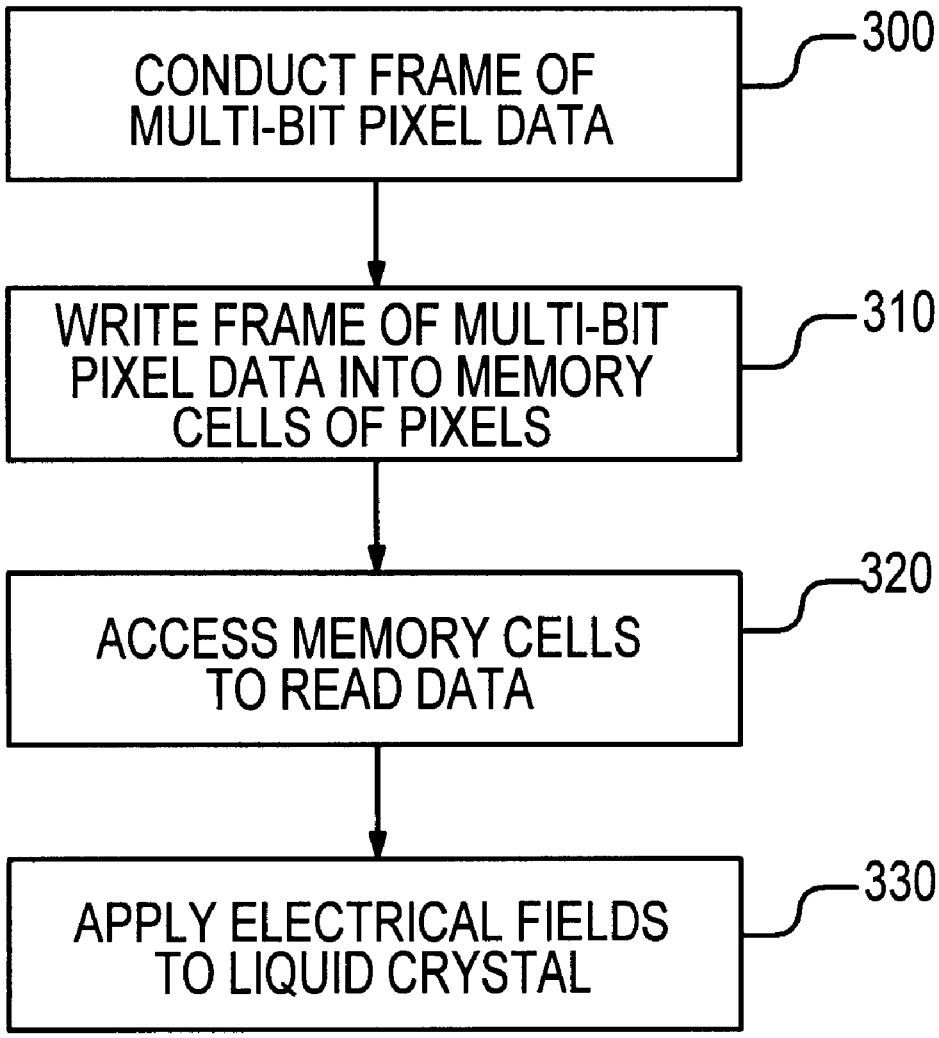
FIG. 12 is a flow diagram of a method of driving liquid crystal in a matrix of pixels of an integrated display device in accordance with the invention.

A method of driving liquid crystal in a matrix of pixels of an integrated display device in accordance with the present invention will be described with reference to FIG. 12. At step 300, a frame of multi-bit pixel data is conducted to memory cells within each of the pixels in the matrix. Each multi-bit pixel data may contain eighteen bits for three colors and six-bit grayscale information for each color, such that a six bit word represents a single color and its associated grayscale. The frame of multi-bit pixel data is received and transferred to the memory cells, a segment at a time. Each segment contains pixel data for a row of pixels in the matrix. A first segment is received and temporarily stored in one of two data registers. After the first segment has been stored into the first data register, a second segment is received and stored into the second data register. The first segment is transferred to a write bit line driver of the integrated display device, which relays the first segment to a row of pixels in the matrix. The write bit line driver relays the first segment in six-bit portions to each of the pixels, such that a third of the first segment is written into the row of pixels in a parallel manner. Preferably, the storing and transferring the segments are performed concurrently.

After the first segment is transferred to the write bit line driver and the second segment is received and stored into the second data register, a third segment is received and stored into the first data register. In addition, the second segment is transferred from the second data register to the write bit line driver. In this alternating manner, all the segments of the frame of multi-bit pixel data are received, stored and transferred in generally continuous flow.

At step 310, the frame of multi-bit pixel data is written into the pixels in the matrix. After the frame of multi-bit pixel data has been written, the memory cells within the matrix of pixels are selectively accessed to display the frame of multi-bit pixel data by sequentially reading the bit of data stored in each memory cell at step 320. Preferably, the sequential reading involves addressing a first read transistor of series-gated transistors within each memory cells only once during a clock read cycle in order to minimize potential data degradation in the memory cells. During step 330, electrical fields are applied to liquid crystal in the pixels of the matrix. The electrical fields correspond to the pixel data that was stored in the memory cells.

What is claimed is:

1. A method of driving liquid crystal in an array of pixels of a digital display device comprising steps of:

conducting at least a major portion of a frame of multi-bit pixel data to said pixels, including directing a plurality of pixel-related bits of said multi-bit pixel data to a plurality of memory cells of a memory array integrated into each of said pixels;

at each of said pixels, writing said plurality of pixel-related bits into said memory cells of said memory array to which said pixel-related bits are directed, each said memory array having a capacity to store said plurality of pixel-related bits;

selectively accessing each of said memory cells of said memory array such that, within each pixel, each of said plurality of pixel-related bits is read in a selected sequence from said memory array of said each pixel, including generating read signals associated with said selected sequence and providing said read signals to said memory cells such that a selected read switch of series-gated switches within each said memory cell is limited to being accessed once during a read cycle; and applying electrical fields to said liquid crystal within individual pixels based upon said sequential reading of each of said plurality of pixel-related bits from said individual pixels.

2. The method of claim 1 wherein said step of directing said plurality of pixel-related bits includes transferring a comprehensive set of color and grayscale information represented by said plurality of pixel-related bits for each of said pixels.

3. The method of claim 1 wherein said step of writing said plurality of pixel-related bits and said step of selectively accessing said cells of said memory array are performed at independent rates.

4. The method of claim 1 further comprising a step of prohibiting simultaneous read and write operations performed on a single cell of said memory cells by monitoring the status of said read operation of said display device.

5. The method of claim 4 wherein said step of prohibiting said simultaneous read and write operations includes a step of providing internally-modified write signals to control said write operation, said internally-modified write signals being correlated to said status of said read operation.

6. A method of driving liquid crystal in a matrix of pixels of an integrated display device comprising steps of:

receiving a plurality of pixel data from a host system by said integrated display device, each of said pixel data including bits representing color and grayscale;

transferring said plurality of pixel data to said matrix of pixels in a parallel manner, at pixel level, such that said bits are collectively transmitted to each of said pixels, said bits being stored in memory cells within said pixels;

reading said bits stored in said memory cells within each of said pixels such that said bits are read in a preselected sequence, including individually addressing each memory cell within each of said pixels by electrically activating series-gated first and second switches within said each memory cell such that both said first and second switches are closed; and applying electrical fields to said liquid crystal within said matrix of pixels in response to said bits read from said memory cells.

7. The method of claim 6 wherein said step of electrically activating said first and second switches includes closing said first switch only once during said preselected sequence.

8. The method of claim 6 wherein said step of transferring said plurality of pixel data includes a step of writing said plurality of pixel data into said memory cells within said pixels in accordance with said step of reading said bits such that simultaneously writing into and reading from a same memory cell is precluded.

9. The method of claim 6 further comprising a step of temporarily storing said plurality of pixel data received from said host system in a frame buffer within said integrated display device.

10. The method of claim 9 wherein said step of temporarily storing said plurality of pixel data and said step of transferring said plurality of pixel data are performed in a concurrent manner.

11. The method of claim 9 wherein said step of temporarily storing said plurality of pixel data includes storing said plurality of pixel data into first and second registers of said frame buffer in an alternating fashion.

12. A liquid crystal display device comprising:

an array of pixels, each pixel including liquid crystal and a plurality of memory cells, each memory cell including a write bit line and a read bit line that are coupled through a series connection of independently addressable first and second switches such that said memory cell is independently accessible with respect to read and write operations;

data-buffering means operatively connected to said array of pixels for selectively relaying digital image data received from an external source to said array of pixels, said data-buffering means having an input for receiving said digital image data from said external source; and a bit line driver coupled to said data-buffering means to transfer said digital image data from said data-buffering means to said array of pixels, said bit line driver being connected to said pixels by a plurality of write bit lines such that pixel-related bits of said digital image data are transmitted to said each pixel in a parallel manner.

13. The display device of claim 12 wherein said data-buffering means includes first and second data storing means for receiving portions of said digital image data from said external source and transferring said portions of said digital image data to said bit line driver in an alternating manner.

14. The display device of claim 12 further comprising read signal-generating means operatively coupled to said array of pixels for providing read signals to said array of pixels to access said memory cells within said each pixel, said read signals corresponding to a preselected sequence for accessing said memory cells during said read operation.

15. The display device of claim 14 further comprising write signal-generating means operatively coupled to said array of pixels for providing write signals to said array of pixels, said write signal-generating means being connected to said read signal-generating means to generate said write signals that are responsive to said read signals.

16. A method of driving liquid crystal in an array of pixels of a digital display device comprising steps of:

conducting at least a major portion of a frame of multi-bit pixel data to said pixels, including:

(a) directing a plurality of pixel-related bits of said multi-bit pixel data to a plurality of memory cells of a memory array integrated into each of said pixels;

(b) temporarily storing portions of said frame of multi-bit pixel data in a first alternating fashion to first and second registers of said display device such that said frame of multi-bit pixel data is relayed through said first and second registers in a generally continuous manner; and (c) transferring said portions of said frame of multi-bit pixel data, that are stored in said first and second registers, to said memory cells in each of said pixels in a second alternating fashion that is the reciprocal of said first alternating fashion of said step of temporarily storing said portions in said first and second registers;

at each of said pixels, writing said plurality of pixel-related bits into said memory cells of said memory array to which said pixel-related bits are directed, each said memory array having a capacity to store said plurality of pixel-related bits;

selectively accessing each of said memory cells of said memory array such that, within each pixel, each of said plurality of pixel-related bits is read in a selected sequence from said memory array of said each pixel; and applying electrical fields to said liquid crystal within individual pixels based upon said sequential reading of each of said plurality of pixel-related bits from said individual pixels.

* * * * *